United States Patent [19]

Boop

[11] Patent Number: 4,457,383

[45] Date of Patent: Jul. 3, 1984

[54] HIGH TEMPERATURE SELECTIVE FIRE PERFORATING GUN AND SWITCH THEREFOR

[76] Inventor: Gene T. Boop, 109 Kenshire, Ft. Worth, Tex. 76126

[21] Appl. No.: 372,152

[22] Filed: Apr. 27, 1982

[51] Int. Cl.[3] ..... E21B 43/116; H01H 9/00

[52] U.S. Cl. ..... 175/4.55; 200/82 B

[58] Field of Search ..... 175/4.55; 200/82 B, 200/82 R, 81.4, 52 R; 102/262, 217, 218

[56] References Cited

U.S. PATENT DOCUMENTS

| | | | |
|---|---|---|---|
| 3,784,771 | 1/1974 | Olsen | 200/82 B |
| 3,941,957 | 3/1976 | Tilman | 200/82 R |
| 4,234,768 | 11/1980 | Boop | 200/82 R X |

*Primary Examiner*—Ernest R. Purser

*Assistant Examiner*—Thuy M. Bui

*Attorney, Agent, or Firm*—G. Turner Moller

[57] ABSTRACT

A multiple shot selective fire perforating gun is provided for piercing oil field tubular goods, typically during the process of completing an oil or gas well. The perforating gun includes a multiplicity of shaped charges which are fired individually by an associated blasting cap and switch. The switch of all but the lowermost charge is configured to disarm its associated blasting cap until the next lower shaped charge has detonated. The generation of the pressure pulse from detonation of the next lower shaped charge causes a piston in the switch to move to compress a body of flowable material. The flowable material acts on a projectile which moves in a switch closing direction to arm the associated blasting cap.

12 Claims, 5 Drawing Figures

HIGH TEMPERATURE SELECTIVE FIRE PERFORATING GUN AND SWITCH THEREFOR

The art of perforating oil field tubular goods is rather well developed. The two basic types of perforating guns are the bullet and shaped charge. In bullet type perforaters, a metal bullet is fired through the casing, through the cement sheath surrounding the casing and into the formation adjacent thereto. In a shaped charge type gun, the shaped charge burns a hole in the casing, in the cement sheath and partially into the formation therearound. Although both type guns have their advantages, the shaped charge type is at present somewhat more common. This invention is usable with either type gun and is designed to selectively fire one perforating element or a small group of elements out of a plurality of elements on the gun.

There are a number of different techniques for selectively firing perforating elements on a perforating gun containing additional perforating elements. The simpliest type is often called a "two gun tandem" in which approximately half of the perforating elements are connected to a source of D.C. voltage through a diode of one polarity and the remaining perforating elements are connected to the source of D.C. voltage through a diode of opposite polarity. Applying a firing current of one plurality of the gun fires the first group of perforating elements while the second group is fired upon applying firing current of opposite polarity thereto. Although this technique is extremely simple, it lacks flexibility since one cannot, for example, assemble a series of 80 perforating elements and selectively fire only a few at a time.

In many hydrocarbon producing areas of the world, producing formations of substantial thickness are encountered in which relatively thin streaks thereof contain sufficient hydrocarbon saturation and exhibit sufficient permeability to warrant completing. It is present practice to selectively perforate only those streaks or sections which exhibit both hydrocarbon saturation and permeability. Since such streaks may be numerous but thin and separated from each other by unproductive sections, it is desirable to provide a perforating gun which can carry a large number of perforating elements which may be selectively fired in very small groups.

In response to this need, multiple wire-multiple shot perforating guns were devices. In these devices, a plurality of separate circuits are employed to fire a like plurality of small groups of perforating elements although this type device works reasonably well, there are understandable complexities involved in producing a large number of circuits in guns which may be no more than about 1½" in diameter. In particular, it is somewhat difficult to seal all of the wiring against liquid leakage. Since many blasting caps have a safety feature whereby they refuse to fire if wet, it will be apparent that numerous problems can attend the manufacture and use of multiple wire-multiple shot perforating guns.

In response to these difficulties, there has been developed a single wire-multiple shot gun. In devices of this type, there are provided a plurality of spaced normally disarmed blasting cap-perforating element assemblages and an armed assemblage. When the armed assemblage is fired, the adjacent blasting cap-perforating element assemblage is armed through the use of a mechanically operated switch. It is this type of selective firing perforating gun that this invention most nearly relates. Disclosures of these type perforating guns are found in U.S. Pat. Nos. 4,007,796 and 4,234,768, the disclosures of which are incorporated herein by reference.

One of the disadvantages of the prior art selective fire perforating guns of this type is their inability to operate satisfactorily in high temperature environments. One of the facts of life of the oil business is that wells are being drilled and completions are being attempted at ever increasing depths. One of the side effects of drilling and completing wells of greater depth is that higher and higher bottom hole temperatures are being encountered. In all known areas of the world, the bottom hole temperature encountered is a direct function of depth. In many parts of the world, bottom hole temperatures exceed 400° F. and approach 500° F. As surely as the sun rises in the east, there will shortly be demands for equipment that is capable of operating above 500° F.

In summary, this invention comprises a select fire perforating gun incorporating a multiplicity of initiator-perforating element assemblages which include a switch unit maintaining the assemblage in a disarmed configuration until the next lower assemblage is fired at which time the switch unit is manipulated to arm the assemblage.

The switch unit comprises a housing or body which is temporarily captivated in the perforating gun and includes a piston exposed to a pressure pulse generated during the firing of the next lower assemblage. The piston acts on a confined body of liquefiable or flowable material which is compressed upon movement of the piston. The compressed material acts against a projectile comprising a part of the switch which moves from a disarmed position to an armed position in response to movement of the flowable material.

The projectile, in the disarmed configuration of the switch unit provides an electrical path extending therethrough which constitutes a hot wire or path leading to unfired assemblages below the switch unit. Upon movement of the piston and consequent compression of the flowable material, the projectile moves to sever the electrical path to lower switch units. After breaking the electrical path to subject assemblages, the projectile moves into electrical engagement with a contact connected to an associated blasting cap. Consequently, the associated blasting cap is armed and may be fired by the application of a firing current of the correct polarity to the hot wire at the surface.

It is accordingly an object of this invention to provide an improved select fire perforating gun and switch therefor which is capable of operation in high temperature environments.

Other objects and a fuller understanding of this invention may be had by reference to the following description taken in conjunction with the accompanying drawings and appended claims.

Figure 1:
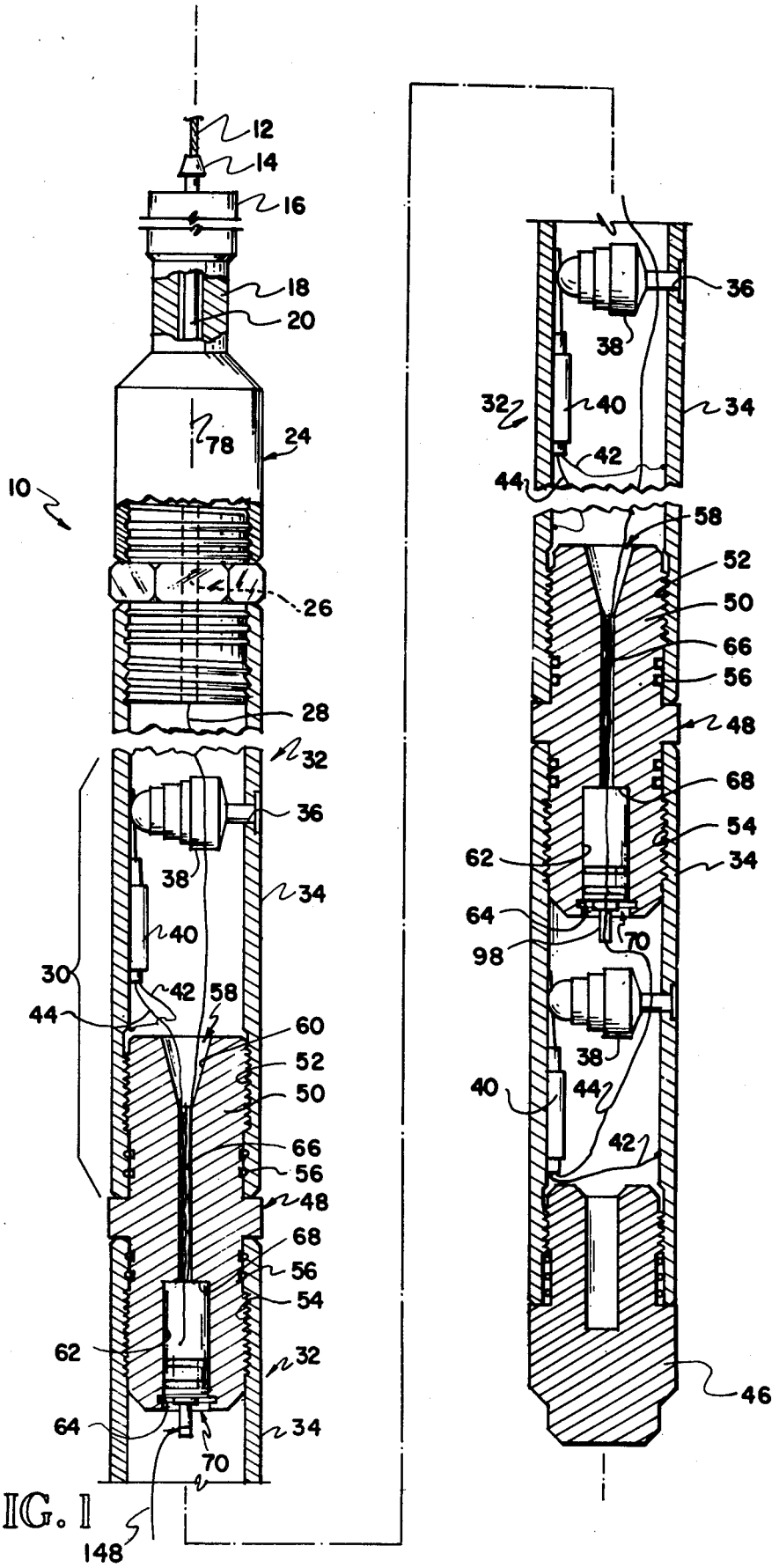
FIG. 1 is a side view of a perforating gun of this invention, certain parts being broken away for clarity of illustration.

Referring to FIG. 1, there is illustrated a perforating gun 10 which is raised and lowered in a well by manipulation of a suitable cable 12 having a central conductive wire, an external conductive sheath and an insulating sheath between the internal and external conductors designed to carry electrical current to various electrical devices in the gun 10. The cable 12 is connected to a suitable rope socket 14 which is conveniently screwed into the top of a conventional collar locator 16. As will be apparent to those skilled in the art, the collar locator 16 is designed to sense a collar or joint between adjacent pipe sections in order to properly position the tool 10. The collar locator 16 is attached to a firing head assembly 18.

The firing head assembly 18 may be of conventional design and provides an internal insulated electrical path 20 which is connected through the collar locator 16 and the cable 12 to a D.C. source at the surface. The path 20 is accordingly part of a firing circuit 22 leading to the perforating elements to be described hereinafter. The firing head assembly 18 is attached onto the top of a sub 24 and provides a passage 26 for a hot wire 28.

Below the sub 24 are a plurality of repeating gun sections 30 each comprising an initiator-perforating element assemblage 32. The gun sections 30 and the assemblages 32 are substantially identical and comprise an internally threaded casing 34 having one or more ports 36 therein for receiving the discharge end of a perforating element 38 which is illustrated as being of the shaped charge variety. An initiator or blasting cap 40 is disposed adjacent the shaped charge 38 for detonating the same in a conventional manner. The basting cap 40 is provided with first and second wires or leads 42, 44 for purposes more fully explained hereianfter.

The lowermost assemblage 32 is conveniently armed in any suitable manner, as by grounding the blasting cap wire 42 to the casing 34 and connecting the other blasting cap wire 44 to the firing circuit 22. In the alternative, the lowermost assemblage 32 may initially be disarmed and provided with a mechanism for arming the same, e.g. means for sensing hydrostatic pressure in the bore hole outside the gun 10 for arming the assemblage when an appropriate bore hole depth is reached. The lower end of the lowermost assemblage 32 is closed in any suitable fashion, as by the provision of a bull plug 46 illustrated in FIG. 1.

The general plan of operation of this invention and of the prior art single wire-multiple shot perforating guns is that the hot wire side of the firing circuit includes a switch for each initiator-perforating element assemblage which completes a bypass circuit to the next lower assemblage while disarming its associated assemblage. Upon firing the lowermost assemblage, the switch of the next upper assemblage is manipulated to arm its associated blasting cap. Firing of the shots carried by the gun 10 then proceeds from the bottom of the gun toward the top thereof. As heretofore illustrated and described, the perforating gun 10 is of substantially conventional design and may be obtained commercially.

A switch sub 48 is connected between adjacent assemblages 32 and comprises a rigid body 50, suitably of machined metal or the like, having upper and lower external threads 52, 54 for coupling with the adjacent gun sections 30. Suitable O-rings 56 seal between the body 50 and the adjacent gun sections 30 to prevent liquid passage into the gun 10. An elongate passage 58 extends axially through the switch sub 48 and comprises an upper conical section 60, a lower cylindrical section 62 having a snap ring groove 64 therein, and an intermediate section 66 communicating between the upper and lower sections 60, 62. The junction between the sections 62, 66 provides an annular shoulder 68 for purposes more fully explained hereinafter. As will be more fully apparent hereinafter, the switch mechanism of this invention is mounted in the passage section 62.

Figure 2:
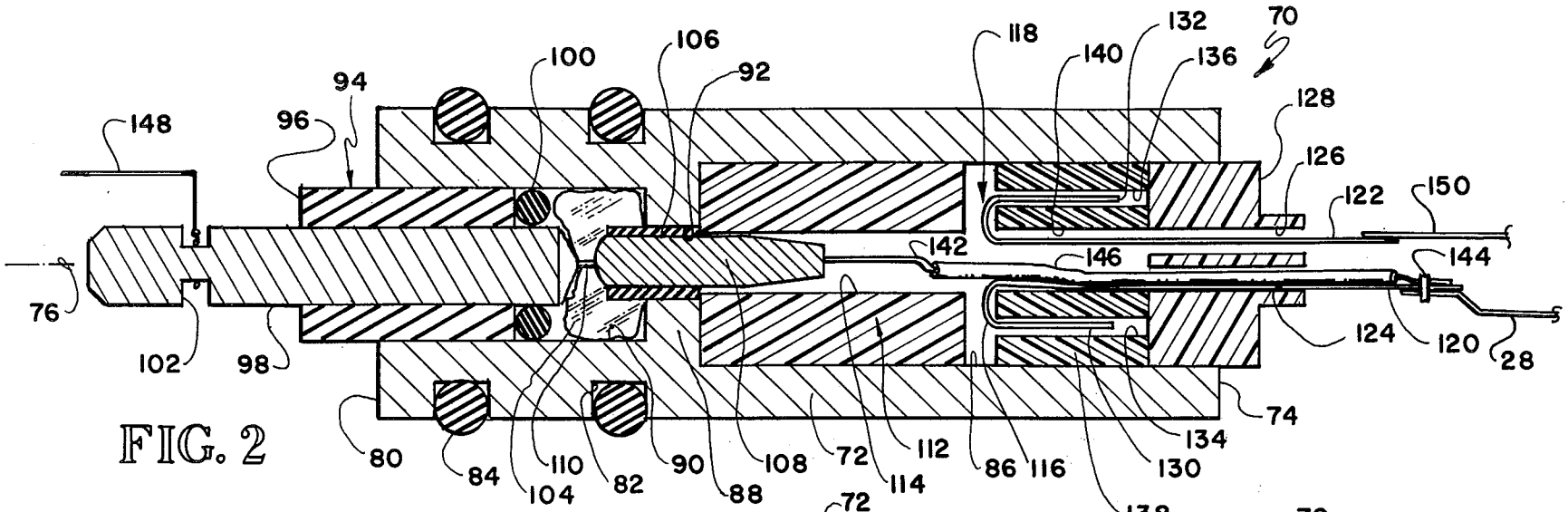
FIG. 2 is a longitudinal cross-sectional view of the switch of FIG. 1 illustrated in the disarmed configuration.
Figure 3:
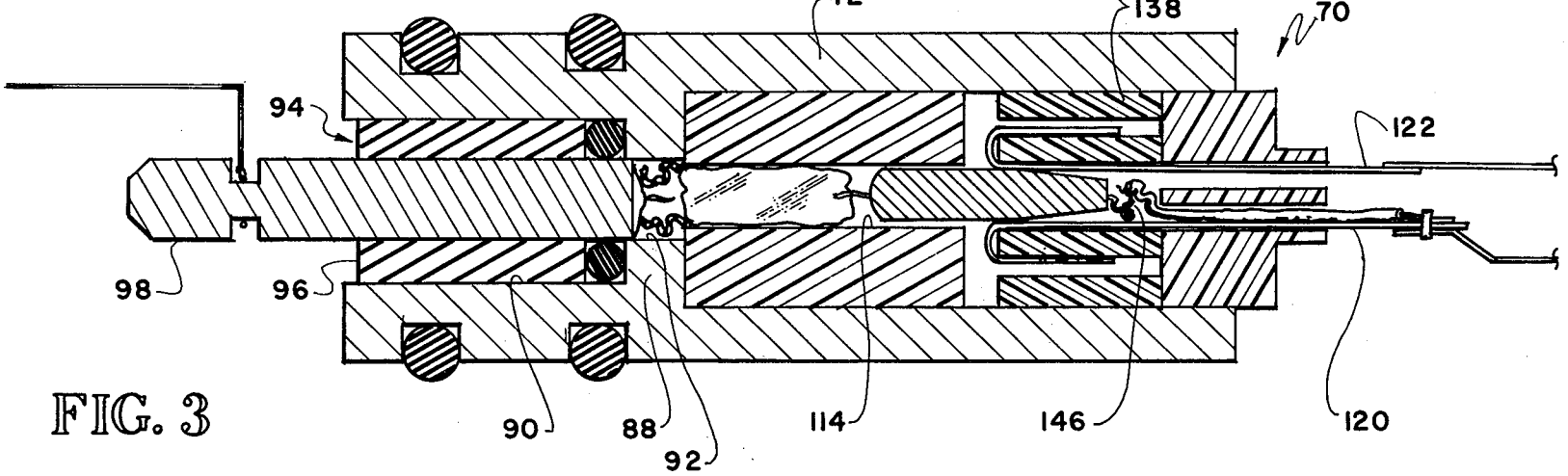
FIG. 3 is a view similar to FIG. 2 illustrating the switch in its armed configuration.
Figure 4:
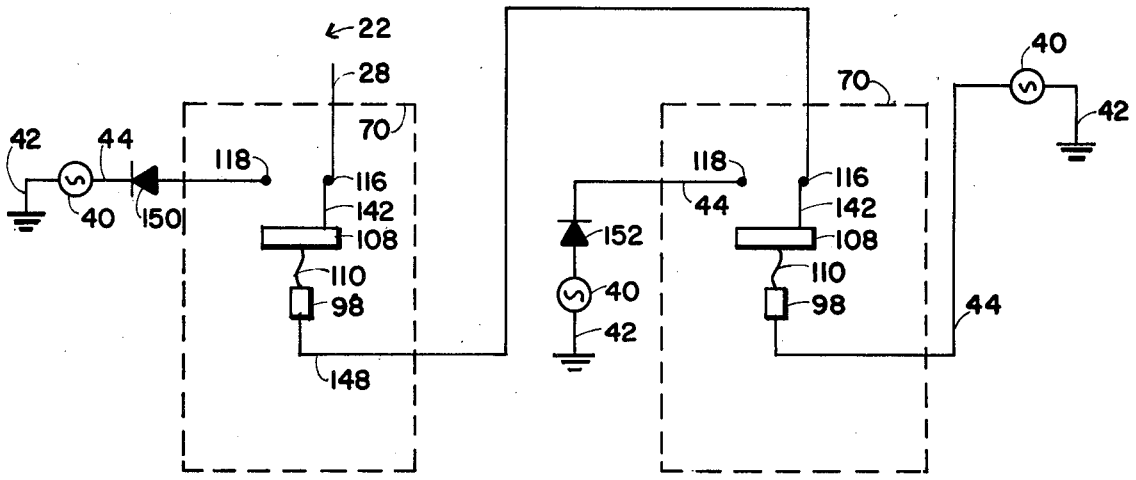
FIG. 4 is a schematic diagram of the electrical circuit through a pair of switch assemblages of this invention illustrated in the unarmed configuration.

Referring to FIGS. 2—4, there is illustrated a switch unit 70 of this invention. The switch unit 70 provides a multiplicity of functions during operation of the perforating gun 10 which may be broadly classified as disarming functions and arming functions. In the disarmed configuration of the switch unit 70, its associated blasting cap 40 is electrically separated from any contact with the firing circuit 22 and an electical bypass circuit is made through the switch unit 70 to provide a hot wire for a subjacent assemblage 32. Responding to the detonation of the subjacent perforating element, the arming functions of the switch unit 70 are placing the blasting cap 40 in circuit with the hot wire 28 and severing the circuit leading to the subjacent fired assemblage 32.

One of the problems in designing a switch unit for a select fire perforating gun is that the pressure pulse generated during firing of the subjacent shaped charge is of considerable magnitude. Although the magnitude of the pressure pulse is unknown, it would not be surprising to learn that the pressure peak is in excess of 30,000 psi. Accordingly, one is faced with the dilemma of constructing an inexpensive extremely rugged switch mechanism. If a mechanical linkage were provided for converting the pressure pulse into switch movement, one difficulty is that the linkage must be designed and assembled to very close tolerances so that the movable switch member is moved precisely the correct distance. For example, if the switch member were moved against a stop and too much movement is attempted, some component will necessarily break or warp. As will become more fully apparent hereinafter, these problems are avoided by spacing the switch mechanism a considerable distance from those components exposed to the pressure pulse and interposing a hydraulic force transmitting device between the movable switch member and the pressure pulse sensing mechanism.

To these ends, the switch unit 70 comprises a rigid generally cylindrical body or housing 72 having a generally planar upper end or face 74 perpendicular to a longitudinal axis 76 of the body 72 which is generally coaxial with a longitudinal axis 78 of the perforating gun 10, a lower face or end 80 generally parallel to the upper face 74.

The exterior of the switch body 72 provides a pair of grooves 82 for receiving O-rings 84 providing a pressure seal between the exterior of the switch body 72 and the passage section 62 in the switch sub 48.

The interior of the switch body 72 comprises a first generally cylindrical passage 86 extending from the upper end 74 toward a partition wall or shoulder 88 and a second passage 90 extending from the lower end 80 toward the partition wall 88 which provides a passage 92 communicating between the passages 86, 90. Although the passage 90 appears to be cylindrical, it is slightly divergent toward the lower end 80 for purposes more fully explained.

Extending into the passage 90 and mounted for limited axial movement therein is a piston assembly 94 comprising a cylindrical sleeve 96 of electrically insulating material such as a phenolic resin, a central pin 98 of electrically conductive material such as metal or the like, and an O-ring seal 100 surrounding the pin 98 and providing a seal between the pin 98 and passage 90 in the disarmed position and sealing against the shoulder or partition wall 88 in the armed position. The pin 98 provides a circumferential groove 102 about the exposed end thereof to allow attachment of an electrical wire leading to the next subjacent assemblage 32. Accordingly, the pin 98 is one of the terminals of the switch unit 70. It will be apparent from FIG. 2 that the switch unit 70 provides a reservoir 104 which is filled with a flowable material, as more fully disclosed hereinafter, and is decreased in size upon upward movement of the piston assembly 94 as more fully pointed out hereinafter.

A sleeve 106 of electrically insulating material, such as Teflon or the like, is inserted in the passage 92 and closely receives an electrically conductive, typically metal bullet or projectile 108. The projectile 108 is exposed to the reservoir 104 and is connected by a breakable wire 110 to the metal pin 98.

An annular bushing 112, of electrically insulating material such as phenolic resin or the like, is located in the cylindrical passage 86 and abuts the shoulder 88 to provide a central passage 114 acting as a barrel for the projectile 108. As will be evident from FIG. 2, the internal diameter of the passage 114 is less than the external diameter of the sleeve 92 so that the sleeve 92 is substantially immobile during actuation of the switch unit 70 and movement of the projectile 108.

The upper end of the switch unit 70 comprises the stationary switch components which inlcude a pair of terminals 116, 118. Each of the terminals 116, 118 comprises a hook shaped member including an elongate shank 120, 122 extending through a passage 124, 126 in an end cap 128 secured, as by a press fit or the like, in the switch body 72. The terminals 116, 118 also comprise a reverted leg 130, 132 disposed in a passage 134, 136 in an annular bushing 138. As is evident, the annular bushing 138 comprises a central passage 140.

A wire 142 is connected, at one end, to the projectile 108 and, at the other end, to a fitting 144 exterior of the switch body 72 for purposes more fully explained hereinafter. A sleeve 146, of electrically insulating material, such as Teflon or the like, is disposed in the passage 140 and receives an intermediate portion of the wire 142 to prevent inadvertent electrical contact between the wire 142 and the shank 122 of the terminal 118. The wire 142 and terminal 116 are electrically connected to the hot wire 28 at the fitting 144. This is desirable in order that a single hot wire may be employed. It will be evident, however, that operation of the switch 70 is independent of how the wire 142 and terminal 116 are connected.

Referring to FIGS. 1–3 and 4, the arrangement of the firing circuit 22 and particularly the wiring of the switch unit 70 is illustrated. For purposes of simplicity, the showings of FIGS. 1 and 4 are described hereinafter as including three blasting caps 40 although it should be understood that as many gun sections 30 may be provided as desired. The hot wire 28 is illustrated in FIG. 1 as extending through the passage 58 and attaches to the fitting 144 of the upper switch unit 70.

As shown in FIGS. 2 and 4, the hot wire 28 is electrically connected to the terminal 116 which connects to the wire 142 and the projectile 108. The projectile 108 is connected by the wire 110 to the metallic pin 98 which is, in turn, connected by a wire 148 to the next subjacent switch unit.

The terminal 118 of the upper switch unit 70 is connected by the wire 44 to the blasting cap 40. The wire 44 includes a diode 150 therein while the wire 42 is grounded.

The next subjacent switch unit 70 is identically configured in the disarmed configuration with the wire 44 connected to the blasting cap 40 and containing a diode 152 of opposite polarity therein.

The lowermost blasting cap 40 has one of its leads 42 grounded with the other lead 44 being connected to the pin 98 of the adjacent switch unit 70. Since the hot wire 28 extends through the cable 12 to the surface, it will be evident that an electrical pulse may be transmitted down the hot wire 28, through any disarmed switch units 70 to detonate the lowermost blasting cap 40. It will also be seen that the leads 44 associated with the disarmed switch units 70 are wholly isolated from any component of the firing circuitry 22 which is energized or grounded during firing of a subjacent blasting cap.

When the lowermost basting cap 40 and shaped charge 38 ignite, a substantial pressure wave is generated in the lowermost housing 34. The piston assembly 94 is exposed to this pressure wave and reacts by moving upwardly in the tapered passage 90 to compress the material in the reservoir 104. Compressing of this material generates an axial force acting on the projectile 108. The projectile 108 is thereupon driven through the passage 114 toward the terminals 116, 118. From an electrical standpoint, the first event to occur is breaking of the wire 110. This causes severing of any electrical connection between the switch unit being manipulated and any subjacent switch units. Consequently, the illustrated switch is of the break-before-make type.

Figure 5:
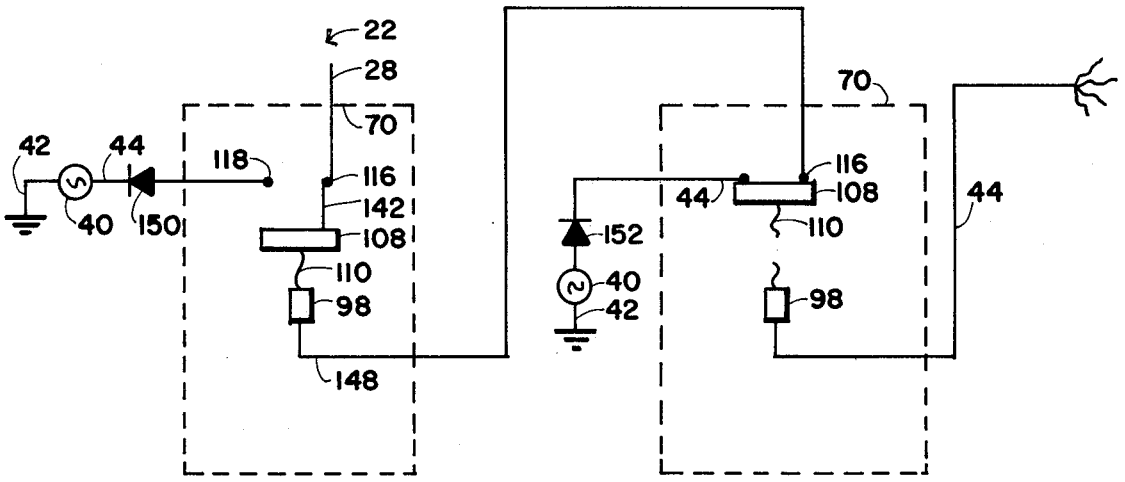
FIG. 5 is a schematic diagram, similar to FIG. 4, illustrating one of the switch assemblages in an armed configuration.

As the projectile 108 emerges from the upper end of the passage 114, the forward tapered end thereof passes between the shanks 120, 122 of the terminals 116, 118. Consequently, the tapered end of the projectile 108 acts as a pilot or centering mechanism for the enlarged body intermediate the ends of the projectile 108. Momentarily, the enlarged part of the projectile 108 comes into electrical contact with both of the terminals 116, 118. It might be thought, at first blush, that the Teflon sleeve 146 would prevent the projectile 108 from contacting the terminal 116. Because the projectile 108 moves at such a velocity and because the sleeve 146 is selected to be of fairly thin material, the projectile 108 becomes wedged against the metallic shanks 120, 122 of the terminals 116, 118 and electrical contact is made. This condition is schematically illustrated in FIG. 5 where the rightmost or lower switch unit 70 is illustrated in the armed configuration. It will be evident that an electrical charge of the proper polarity, applied to the hot wire 28, will pass the diode 152 to detonate the blasting cap 40.

In a similar manner, firing of the blasting cap 40 and shaped charge 38 associated with the lower switch unit 70 acts to arm the upper switch unit 70 which can then be fired by the application of DC voltage of opposite polarity to the hot wire 28. It will be evident to those skilled in the art that orientation of the diodes 150, 152 dictates what polarity of DC voltage will fire the blasting cap associated therewith.

It often happens that the O-ring seals associated with a particular gun section 32 will leak thereby allowing mud or other completion liquid to enter the housing 34 and pressurize it to hydrostatic pressure existing in the well at the depth of the gun 10. Absent any special provisions, the switch unit 70 exposed to hydrostatic pressure will inadvertantly arm since the pressure differential would be sufficient to move the piston assembly 94 in a cylindrical passage to express the flowable material against the projectile 108 and cause the projectile 108 to move in switch closing contact with the terminals 116, 118. Thus, a switch unit could be inadvertantly armed. Normal operating procedures might detect the inadvertant arming of a particular switch and prevent inadvertant firing thereof when an attempt is made to fire the lowermost shaped charge. Even if an inadvertant firing would avoided, it would be necessary to remove the tool from the hole and repair the inadvertantly armed gun section. Accordingly, the relationship between the passage 90 and the piston assembly 94 is selected to retard creep of the piston assembly 94 in response to gradually increasing hydrostatic pressure. Instead of a close cylindrical-to-cylindrical fit as might be expected, it is preferred that the piston assembly 94 and the passage 90 have a progressively increasing interference fit. A convenience technique for accomplishing this interference fit is for the sleeve 96 to be cylindrical and the passage 90 to be frustoconical and downwardly diverging. The amount of divergence of the passage 90 is desirably small, i.e. less than about 10° and preferably is on the order of 2°.

The reservoir 104 is filled with a flowable material which is expressed against the projectile 108 to affect movement thereof as is now evident. This material may be a solid or semi-solid at atmosphere temperatures and pressure and have the capability of flowing, i.e. being expressed or extruded, at normal temperatures existing in well bores where the gun 10 is to be used. Because well bore temperatures vary quite widely, it is desirable that any phase change of the material occur at a temperature substantially higher than any anticipated in the well bore. Although it is conveivable that the material may be electrically conductive, it is highly perferred that the material be electrically insulating. Although a number of compositions fit this description, a silicone grease, such as is available from General Electric Company or Dow Corning has proved satisfactory.

Although the invention has been described in its perferred form with a certain degree of particularly, it is understood that the present disclosure of the perferred form is only by way of example and that numerous changes in the details of construction and the combination and arrangement of parts may be resorted to without departing from the spirit and scope of the invention as hereinafter claimed.

I claim:

1. A perforating gun comprising a plurality of normally disarmed electrically fireable initiator-perforating element assemblages and means providing an armed electrically fireable initiator-perforating element assemblage; and means for sequentially firing the assemblages including circuit means including first and second elongate electrical conductors for providing electrical communication between the earth's surface and the perforating gun when it is run in a well for electrically firing any armed assemblage; and a switch unit associated with each disarmed assemblage for electrically separating the initiator thereof from contact with at least one of the electrical conductors and responsive to firing of an adjacent assemblage for arming the associated assemblage including means placing the initiator of the associated assemblage in circuit with the firing circuit means including the first and second electrical conductors;

the switch unit comprising a first terminal connected to the associated initiator-perforating element assemblage; a second terminal connected to a first adjacent assemblage; a third terminal connected to a second adjacent assemblage; a housing having a chamber therein receiving a flowable material; means for applying pressure to the flowable material including a piston assembly having an electrically conducted component comprising one of the terminals; a projectile, in the chamber, exposed to the flowable material and propelled thereby from a first position toward a second position, the projectile being electrically connected to the conductive component in the first projectile position and electrically separated therefrom in the second projectile position; a first circuit, including the projectile in the first position thereof, through the switch connecting the second and third terminals; and a second circuit, including the projectile, in the second position thereof, through the switch connecting the first and second terminals.

2. A switch comprising a least three terminals; a housing having a chamber therein receiving a flowable material; means for applying to the flowable material comprising a piston assembly having an electrically conductive component comprising one of the terminals; a projectile in the chamber exposed to the flowable material and propelled thereby from a first position toward a second position, the projectile being electrically connected to the conductive component in the first projectile position and electrically separated therefrom in the second projectile position; a first circuit, including the projectile in the first position thereof, through the switch connecting two of the terminals; and a second circuit, including the projectile, in the second position thereof, through the switch connecting different ones of the terminals.

3. The switch of claim 2 wherein the flowable material is electrically insulating.

4. The switch of claim 3 wherein the flowable material is silicone grease.

5. The switch of claim 2 wherein the housing comprises an electrically conductive body and further comprising an electrically insulating body having a passage therethrough leading from the first projectile position to the second projectile position, and comprising a barrel for the projectile.

6. The switch of claim 2 wherein two of the switch terminals comprise generally J-shaped conductive structures each having a shank and a reverted portion, the shanks being spaced apart at the second projectile position.

7. The switch of claim 6 further comprising an electrically insulating bushing having a central passage receiving the shanks and sized to receive the projectile, the bushing further providing passages for receiving the reverted portions of the terminals.

8. The switch of claim 7 further comprising an electrically insulating sleeve having a pair of spaced passages receiving the shanks of the terminals, the sleeve being positioned to block the central passage of the bushing.

9. The switch of claim 2 wherein a wire connects the projectile and the conductive component.

10. The switch of claim 9 wherein the wire is shorter than the distance of travel of the projectile from the first position to the second position.

11. The switch claim 2 wherein the first circuit includes a wire extending from one of the other switch terminals to the projectile.

12. The switch of claim 2 wherein the housing is electrically conductive and further comprising an insulating sleeve spacing the projectile from the housing in the first projectile position.

* * * * *